US008881466B2

(12) United States Patent
Roberts

(10) Patent No.: US 8,881,466 B2
(45) Date of Patent: Nov. 11, 2014

(54) INSULATED DOOR AND METHOD OF ASSEMBLING AN INSULATED DOOR

(75) Inventor: Mark Roberts, Orange (AU)

(73) Assignee: AB Electrolux (SE)

( * ) Notice: Subject to any disclaimer, the term of this patent is extended or adjusted under 35 U.S.C. 154(b) by 0 days.

(21) Appl. No.: 13/510,844

(22) PCT Filed: Nov. 19, 2010

(86) PCT No.: PCT/AU2010/001559

§ 371 (c)(1),
(2), (4) Date: Aug. 9, 2012

(87) PCT Pub. No.: WO2011/060501

PCT Pub. Date: May 26, 2011

(65) Prior Publication Data

US 2012/0297690 A1 Nov. 29, 2012

(30) Foreign Application Priority Data

Nov. 20, 2009 (AU) ..... 2009905701

(51) Int. Cl.
*A47B 96/04* (2006.01)
*F25D 23/02* (2006.01)

(52) U.S. Cl.
CPC . *F25D 23/02* (2013.01); *Y10S 49/01* (2013.01)
USPC ..... 49/504; 49/DIG. 1; 312/405.1; 312/408

(58) Field of Classification Search
CPC ..... E06B 3/263; E06B 3/267; E06B 3/67; F25D 23/02; F25D 23/04; F25D 23/06; F25D 23/065; F25D 23/067
USPC ..... 49/501, 504, DIG. 1, DIG. 2; 52/455, 52/656.4, 656.9; 312/405, 405.1, 408
See application file for complete search history.

(56) References Cited

U.S. PATENT DOCUMENTS

| | | | | | |
|---|---|---|---|---|---|
| 2,330,044 | A | * | 9/1943 | Gaston | 312/293.2 |
| 2,548,593 | A | * | 4/1951 | Eagles et al. | 248/239 |
| 2,866,675 | A | * | 12/1958 | Kesling | 312/405 |
| 3,178,061 | A | * | 4/1965 | Giacalone et al. | 222/129 |
| 3,331,646 | A | * | 7/1967 | Peters | 312/270.3 |

(Continued)

FOREIGN PATENT DOCUMENTS

| | | |
|---|---|---|
| JP | 1-123982 | 5/1989 |
| JP | 3-279774 | 12/1991 |
| JP | 8-210767 | 8/1996 |
| KR | 1020070056526 | 6/2007 |

*Primary Examiner* — Katherine Mitchell
*Assistant Examiner* — Abe Massad
(74) *Attorney, Agent, or Firm* — RatnerPrestia

(57) ABSTRACT

An insulated door (10029 includes a door frame made of four side members (1006, 1008, 1010, 1012) connected by four corner connectors (1014, 1016, 1018, 1020). The frame members are profiled "L" shaped extrusions having outer panel locating ribs (6035), and inner panel retaining slots (6007). The corner connector has a base (4044) with a projecting post (4040). A first pair of connector tabs (4022, 4044) project from adjacent sides of the base to cooperate with first connection slots (6028) of adjacent side members and a second pair of connector tabs (4042, 4043) project from the post to cooperate with connection slots (6026) of the adjacent side members. The outer panel is located on the opposite side of the frame by location ribs (6036). The legs (6009, 6011) of the extrusion define a space D between the inner and outer door panels, and this space is filled with foam insulation.

17 Claims, 10 Drawing Sheets

(56) References Cited

U.S. PATENT DOCUMENTS

| | | | | | |
|---|---|---|---|---|---|
| 3,669,520 | A | * | 6/1972 | Jansen | 312/351 |
| 4,195,888 | A | * | 4/1980 | Squire | 312/408 |
| 4,615,448 | A | * | 10/1986 | Johnstonbaugh | 211/94.01 |
| 4,735,468 | A | * | 4/1988 | Taylor et al. | 312/408 |
| 4,779,939 | A | * | 10/1988 | Stich | 312/405 |
| 4,920,696 | A | * | 5/1990 | Mawby et al. | 312/404 |
| 4,955,675 | A | * | 9/1990 | Donaghy | 312/405 |
| 5,048,233 | A | * | 9/1991 | Gidseg et al. | 49/501 |
| 5,185,971 | A | * | 2/1993 | Johnson, Jr. | 52/36.6 |
| 5,306,082 | A | * | 4/1994 | Karlin et al. | 312/405 |
| 5,692,817 | A | * | 12/1997 | Jun et al. | 312/408 |
| 5,855,424 | A | * | 1/1999 | Hamilton et al. | 312/408 |
| 6,729,705 | B2 | * | 5/2004 | Wolanin et al. | 312/408 |
| 7,300,120 | B2 | * | 11/2007 | Shin | 312/404 |
| 2008/0042537 | A1 | * | 2/2008 | Kim et al. | 312/405 |
| 2008/0048540 | A1 | * | 2/2008 | Kim | 312/408 |

* cited by examiner

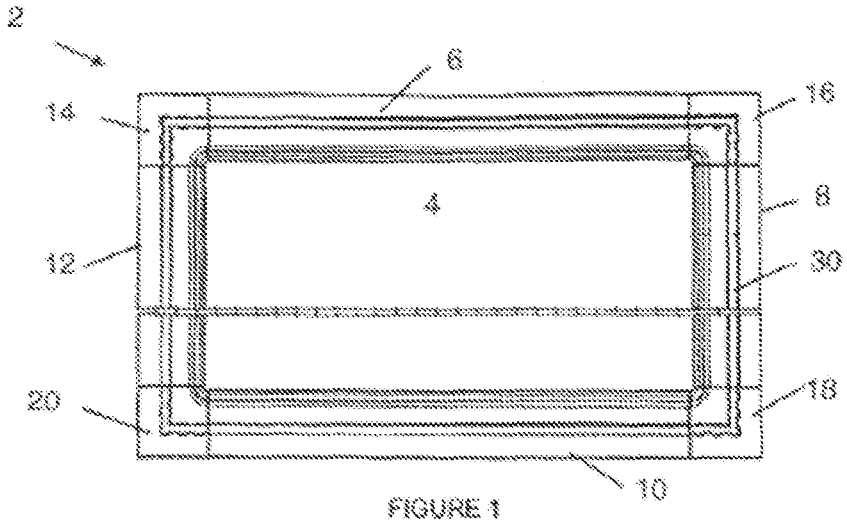
FIGURE 1
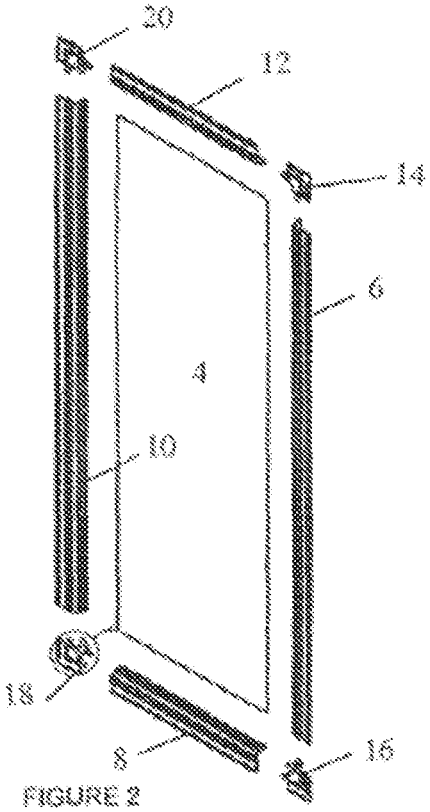
FIGURE 2
FIGURE 3
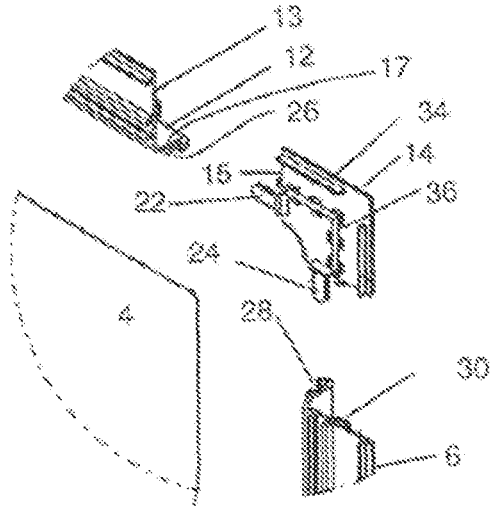

FIGURE 4
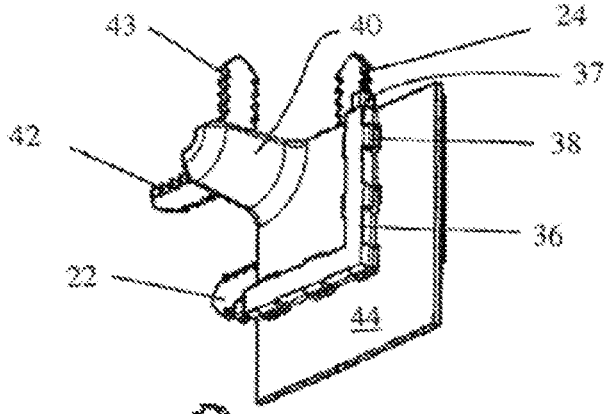
FIGURE 5
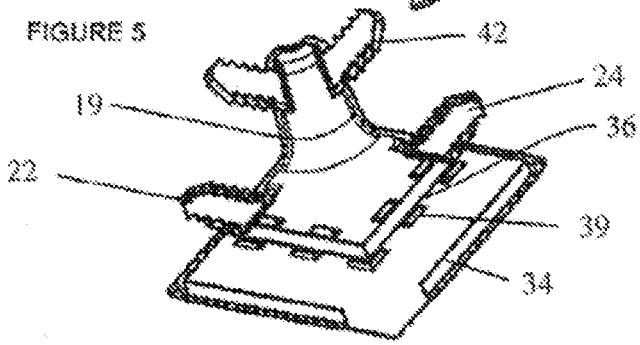
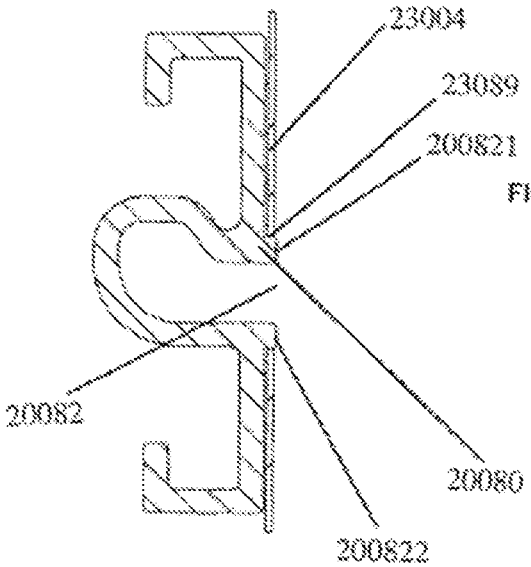
FIGURE 24
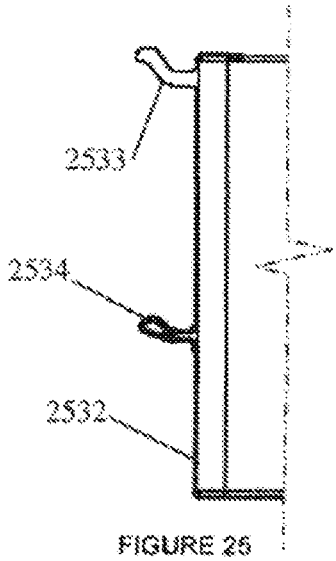
FIGURE 25

FIGURE 6
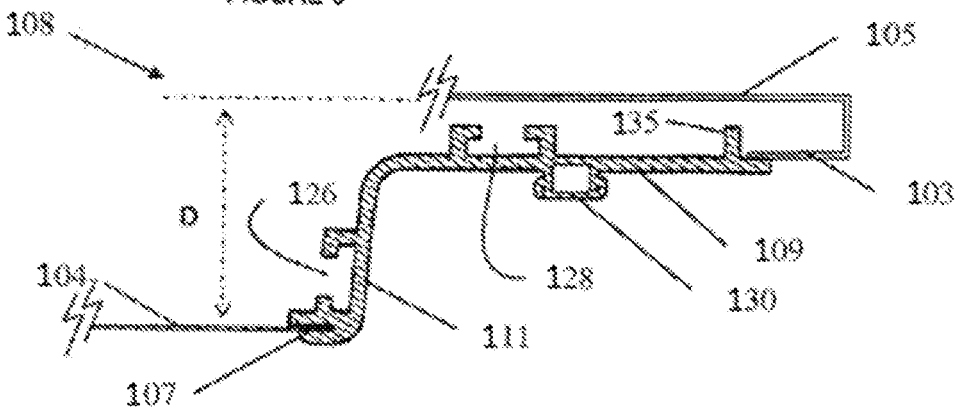
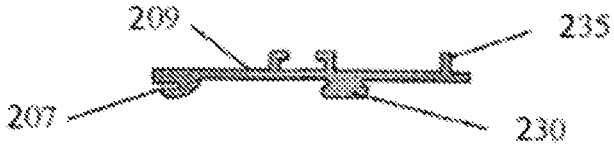
FIGURE 7
FIGURE 8
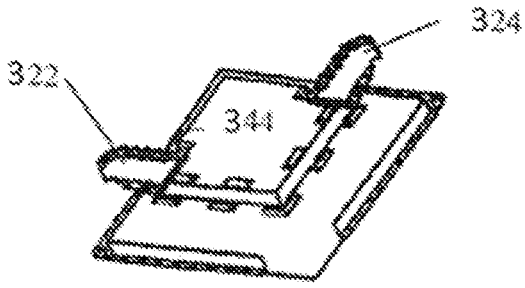

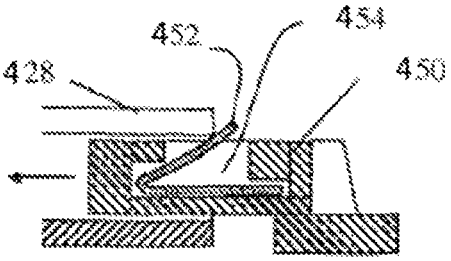
FIGURE 11
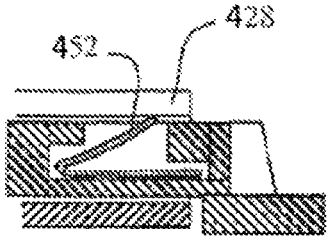
FIGURE 12
FIGURE 13
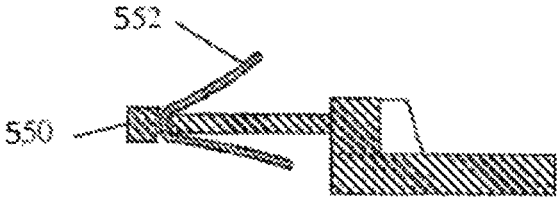
FIGURE 14
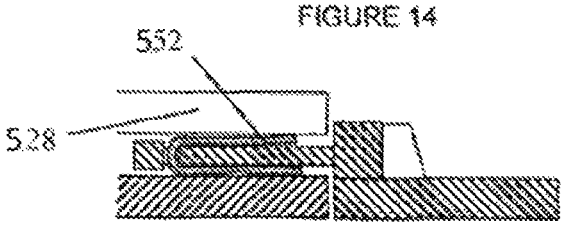

INSULATED DOOR AND METHOD OF ASSEMBLING AN INSULATED DOOR

This patent application is a national stage of International Patent Application No. PCT/AU2010/001559 which claims priority to AU Patent Application No. 2009905701, filed Nov. 20, 2009, the disclosure of each of which is herein incorporated by reference.

FIELD OF THE INVENTION

This invention relates to cold appliances such as refrigerators, freezers, combination freezer/refrigerators, wine coolers, pantries, side by side refrigerator/freezers, multi door and or underbench or undercounter refrigerators, and combination freezer, fridge and wine cooler combinations and similar appliances for domestic and commercial and other uses.

The invention is particularly suited for the assembly of insulated doors for such appliances.

BACKGROUND OF THE INVENTION

The manufacture of cold appliances is commonly done close to the customers because of the bulky nature of the appliances, a large proportion of the volume being empty space. This increases the cost of transportation. The cabinet must be easily assembled to form a rigid structure with good thermal insulation characteristics, and to resist moisture migration, and must have an aesthetically attractive appearance. A further complication is that the cabinet must contain technical equipment for performing different functions. In particular, cold appliances must have a refrigeration system and associated sensors and controls.

Another problem associated with the manufacturing of cold appliances is that it involves high investment costs for the development of product lines and the like. Conventional manufacturing plants for cold appliances are usually inflexible, so that it is difficult to adapt the plant for manufacturing cold appliances with differing dimensions and variable component options in small series. Normally, new product designs require large production runs to be economically feasible. Thus the developers are discouraged from innovation, or variations in product design are very costly.

It is desirable to provide a cold appliance which can be manufactured in segments amenable to transport and which can be assembled into a cabinet at another location which does not need the complex and expensive manufacturing equipment of the primary manufacturing site. The segments should be easy to assemble and interconnect.

This invention proposes a design for an insulated door for a cold appliance which is adapted to meet one or more of these criteria.

Any reference herein to known prior art does not, unless the contrary indication appears, constitute an admission that such prior art is commonly known by those skilled in the art to which the invention relates, at the priority date of this application.

SUMMARY OF THE INVENTION

The present invention provides a door frame member in the form of a profiled extrusion characterized in that the extrusion has a cross-section having a first leg and a second leg, the second leg being inclined to the first leg.

The first leg or second leg or both can include a connection slot.

The first leg or second leg or both can include a gasket attachment rib, groove or channel.

The first leg can include the first panel location means and the second leg can include the second panel location means.

The first panel location means can be a first longitudinal rib or flange.

The second panel location means can be a slot.

The extrusion can include a gasket retaining means, such as a rib, a groove or a channel.

The gasket retaining means can be a longitudinal rib.

The longitudinal rib can have a "T" cross-section.

The invention also provides a corner connector having a base and a transverse post projecting from a corner of the base, at least one connector member projecting from a pair of adjacent sides of the base. There can also be present and a second connector members projecting from the post, the second connector members being substantially parallel with the first connector members.

The corner connector can include a pair of panel locating ribs.

The corner connector can include gasket attachment means, such as a rib, groove or channel.

The present invention also provides an insulated door frame adapted to carry a first door panel and a second door panel, characterized in that the frame includes four side members and four corner connectors, each side member including first panel locating means for locating the first panel and second panel locating means for locating the second panel.

The first panel can be an external panel, and can be made of a material such as stainless steel or polymer coated sheet metal or painted sheet metal.

The second panel can be located on the inside of a cabinet, when the door is closed.

The second panel can be generally planar in shape, or alternatively it can have a generally dyke shape, so as to provide said cabinet with greater volume.

The second panel can include at least one bin slot subassembly or member in the finished assembly.

The present invention further provides an insulated door including a door frame, a first panel, and a second panel, characterized in that the frame includes four side members and four corner connectors, each side member including first panel locating means for locating the first panel and second panel locating means for locating the second panel.

The invention also provides a method of assembling an insulated door including the steps of: attaching the side members to second door panel, connecting the side members using the corner connectors, placing the first door panel in position on the frame, and filling the cavity between the first and second door panels with insulation.

The present invention also provides a door frame connector having a substantially flat body and at least one connection extending from adjoining sides thereof.

The at least one connection can include a barbed projection.

The connection can include a metal spring element to interlock said connector to a mating door frame member.

The present invention also provides a bin slot member having a central body portion in which a shaped groove is located to receive a mating protrusion on a storage bin, the central body portion including adhesive receiving surfaces adjacent said groove.

The central body can be extruded from one of a polymeric material, or a metal such as aluminum.

End caps can be provided to close off the ends of the groove.

The caps can also include one or more adhesive receiving surfaces.

Adhesive, such as double sided tape, can be applied to adhesive surfaces on the bin slot member for attachment to a door lining.

Along an upper and lower edge of the groove there can be located a protruding lip, which is adapted to protrude through and finish proud of the outboard surface of a panel to which said bin slot member is to be assembled.

The present invention also provides a method of assembly of a door lining with bin slots therein, the method including the following steps in any order: installing a jig in to a groove of a bin slot member; applying adhesive to adhesive surfaces of the bin slot member.

A later step can include adhering the bin slot member to the rear side of a door lining, by passing the jig through a slot in the door lining, and allowing adhesive on the adhesive surfaces contact said door lining.

The present invention also provides refrigerator or freezer having a door with a bin slot member as described above, or as made by the method described above.

BRIEF DESCRIPTION OF THE DRAWINGS

An embodiment or embodiments of the present invention will now be described, by way of example only, with reference to the accompanying drawings, in which:

FIG. 1 is a schematic illustration of an insulated door according to an embodiment of the invention.

FIG. 2 is a schematic exploded view of part of a door according to an embodiment of the invention.

FIG. 3 illustrates detail of a corner assembly according to an embodiment of the invention.

FIG. 4 is an isometric view of a corner connector of FIG. 3

FIG. 5 is an isometric view of the underside of the corner connector of FIG. 4.

FIG. 6 is a section view of a frame member according to an embodiment of the invention.

FIG. 7 shows the cross-section of a side member extrusion according to an alternative embodiment of the invention.

FIG. 8 shows a corner connector according to an alternative embodiment of the invention.

FIGS. 11 & 12 show schematic illustrations of the operation of the connector lugs of FIG. 9.

FIGS. 13 & 14 show an alternative embodiment of the connector lugs.

FIG. 24, located on sheet 2/10, is a cross section through a bin slot subassembly assembled to a door panel.

FIG. 25, also located on sheet 2/10, is a side view of a door bin which will be received into and held by two bin slot sub-assemblies assembled to a door panel, in the finished appliance.

Figure 9:
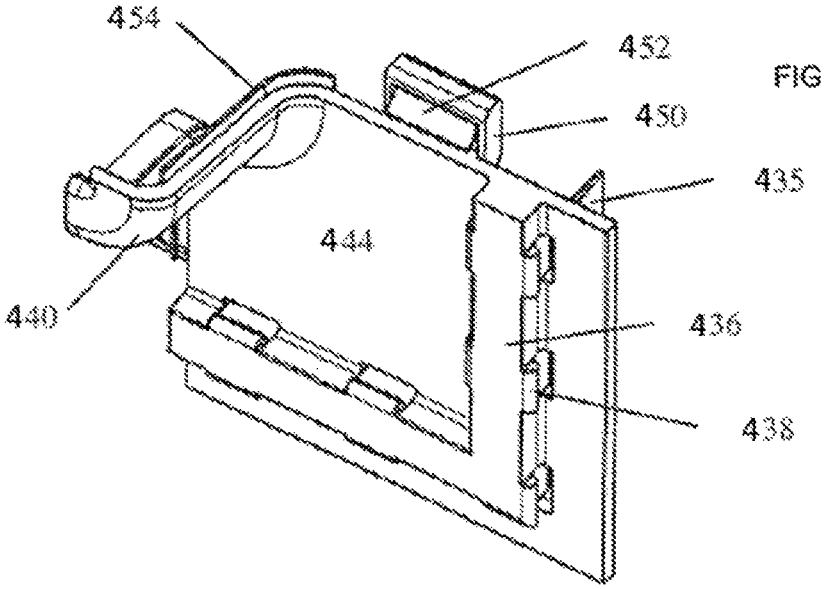
FIG. 9 shows a view of a corner connector according to a further alternative embodiment of the invention.

It is understood that the drawings are intended to be illustrative rather than exact reproductions, and are not necessarily drawn to scale. The orientation of the drawings is chosen to illustrate the features of the objects shown, and does not necessarily represent the orientation of the objects in use.

DETAILED DESCRIPTION OF THE EMBODIMENT OR EMBODIMENTS

The invention will be described with reference to the accompanying drawings.

FIG. 1 is a schematic plan view of a door assembly 2 according to an embodiment of the invention showing the inner panel 4. The door has a frame assembly including four side members 6, 8, 10, and 12 forming a rectangle and connected at the corners by corner connectors 14, 16, 18, 20. The panel is located by panel location slots 107 (see FIG. 6) A gasket attachment flange or rib 30 surrounds the perimeter of the panel 4 and is spaced from the edge of the panel. An outer door panel 105 (see FIG. 6) is not illustrated in FIG. 1.

FIG. 2 shows an exploded view of the door assembly of FIG. 1, but does not show the outer door panel 105 (FIG. 6).

FIG. 3 illustrates a corner assembly of the door arrangement of FIGS. 1 & 2. Each edge member such as 6, 12 is formed of an elongate profiled extrusion which includes features such as the gasket attachment rib 30, outer panel location ribs (see 135 in FIG. 6), and connection slots 26, 28. The profile of the edge members is shown in detail in FIG. 6.

The inner door panel is shown in part at 4. The inner door panel can be a flat panel.

The corner connector has a straight edge 15 which is adapted to mate with the edge 13 of the side member, and the post 40 of the corner connector has an edge 19 adapted to mate with the edge 17 of the side member. As discussed below, the assembled door is filled with foam insulation, and the corner connector serves to close off the corner of the door frame to retain the foamed insulation during the foam injection.

The corner connector 14 is illustrated in greater detail in FIGS. 4 & 5, and includes a substantially flat body 44 with a transverse projection 40, which is in the form of a segment of a miniature bollard or post at one corner. The "bollard" projection in this embodiment has a curved form, with a convex curvature facing the body 44. As shown in FIG. 5, the concave curvature of the underside view faces away from the body 44.

The body carries a gasket attachment rib arrangement 36 which forms a bend to accommodate the corner of the gasket (not shown). The ends of the gasket attachment rib can include lugs, such as 37 adapted to be inserted into the ends of the gasket attachment ribs, such as 130, of the adjoining side members.

Projecting from a pair of adjacent edges of the body 44 are a pair of connector tabs 22, 24 which are mutually angled for insertion into the connector slots such as 128 of a pair of adjacent side members.

A second pair of connection tabs 42, 43 project from the transverse projection 40 and are angled to connect with slots 126 of the pair of adjacent edge members. The tabs 42, 43 are in a separate plane from the plane of the tabs 22, 24. This enables the two pairs of tabs to accommodate the bent section of the side members such as 108. The height of the bollard 40 is sufficient to enable the tabs to align with their corresponding slots in the adjacent extrusions and to conform with the separation D between the exterior and interior panels.

The corner connectors can be made of any suitable material such as plastic, metal, or a combination of plastics and metal, and can be moulded, pressed etc., as appropriate.

The tabs 22, 24, 42, 43 have serrated edges and a pointed front edge. The tabs 22, 24 are substantially flat and substantially within the plane of the body 44. The tabs 42, 43 are also substantially flat and the plane of these tabs is inclined to the plane of the body 44. This enables the tabs 42, 43 to engage with the slots such as 126 which are also inclined in relation to the slots 28.

The gasket attachment ribs 36 projects out of the plane of the body 44 on the same side as the projection bollard 40 and carries lugs such as 38 to, facilitate connection with a gasket in the region of the corner. The gasket can include a slot adapted to snap fit over the ribs 130. The ribs 130 can have a continuous T section along the entire length of the edge members to cooperate with the snap fit slot in the gasket. However, at the corner connectors, the lugs 38 allow for the transition of alignment of the gasket at the corner.

As shown in FIG. 5, the lugs (38) are formed in the base material at 39. The panel locating ribs such as 34 project from the base on the opposite side to the bollard 40.

FIG. 6 illustrates a cross-section of a frame edge member 108. The edge member has a substantially "L" shaped section having a first leg 109 and a second leg 111 inclined to the first leg. The angle between the first and second legs 109, 111 can be a right angle, but it is not necessary for this angle to be a right angle. The outer door panel, shown in part at 105 is an open box having an inwardly projecting flange 103 which fits over and is located by door locating rib 135. Because this arrangement is used on all four sides the ribs 135 serve to locate the door panel 105 in position on the frame. When the inner door panel 104 is installed in the slots 107, the outer door panel 105 thus forms an enclosure having a depth "D" which can be filled with foamed insulation. The insulation will adhere to the panels and provide adhesion for the various components of the door.

The outer door panel 105 can be held in position by adhesive or double sided tape adjacent to the ribs 135, or other suitable means. If desired, the outer door panel and the rest of the components can be held in a jig while the foam insulation is injected. Subsequently, the foam will hold the components together, and there will be no need for use of adhesives or masking tapes to hold the pre-foamed assembly together, as the jig will resist the expansion forces which would otherwise cause separation of the components as the foam expands.

In an alternative embodiment shown in FIG. 7, the side member, extrusion can be a substantially planar member 209 without the "L" cross-section 109, 111, and the corner member (FIG. 8) is likewise a substantially planar member 344 without the transverse post 40. This is the case, for example, when a low profile door is required. In such a case, the depth D is solely determined by the width of the peripheral channel around the outer door panel 105. In such an arrangement the inner panel slot 207 is substantially co-planar with the body from which the outer panel location rib 235 protrudes. The two dimensional corner piece 344 has a pair of serrated tabs 322, 324.

The slots 126 and 128 serve a second function, that is, once the expanding foam has been applied to the internal portions of the door assembly, the foam will expand and set inside the channels of 126 and 128 thus providing and interlocking join between the set foam and the channels 126 and 128.

FIG. 9 shows a view of a corner connector according to a further alternative embodiment of the invention in which the connector tabs have been replaced by spring-loaded lugs. The lugs 450 incorporate a spring element or resilient tang 452 which has an inclined surface oriented to permit easy insertion into a connector slot such as 128, but to resist removal from the connector slot.

In this embodiment, only one pair of connector lugs are provided on the body 444, and no lugs are provided on the post 440. To help prevent leakage during foaming, an edge flange 454 is provided on either side of the post, so that, if any movement of the post relative to the mating side members occurs, the flanges will help to prevent leakage of the foam.

Figure 10:
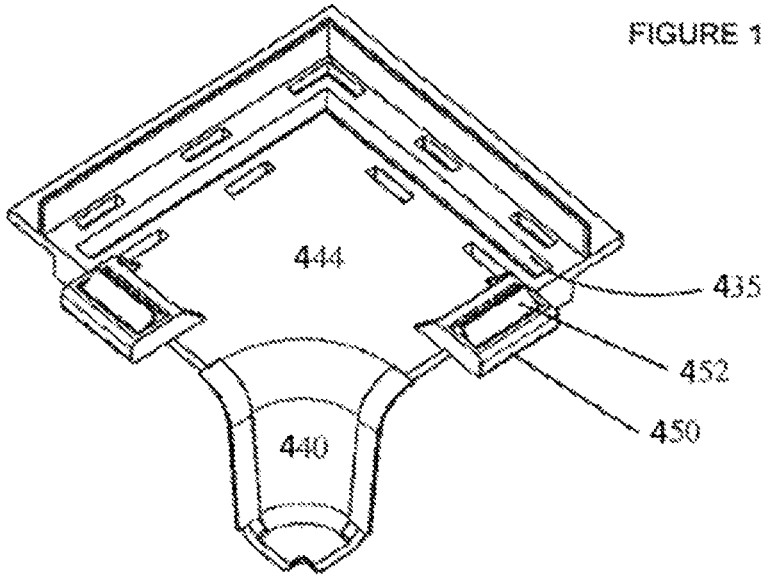
FIG. 10 shows an underside view of the corner connector of FIG. 9.

FIG. 10 shows an underside view of the corner connector of FIG. 9.

FIGS. 11 & 12 are section views which illustrate the operation of the retention tang 452. The lug 450 includes a recess 454 adapted to retain "V" shaped spring element 452. In FIG. 11, the lug 450 is partially inserted into the connection slot 428, in the direction of the arrow. As can be seen, the tang 452 is dimensioned so that it projects above the edge of the slot 428, and presents a camming surface to the upper edge of the slot, which does not present significant resistance to insertion. As shown in FIG. 12, the tang 452 is compressed into the retaining recess 454 due to interaction with the top wall of the slot 428. However, the distal end of the tang 452 now is in contact with the upper wall of the slot 428, and tends to resist removal of the lug from the slot.

The spring 452 can be made of, for example, spring steel. The corner connector can be metal or plastics.

FIGS. 13 & 14 show an alternative embodiment of the lugs. The lug 552 forms a double-sided resilient barb which projects on either side of the lug 550. When inserted into the slot 528, the spring loaded barb resists removal because the two distal ends are pressed against the walls of the slot 528.

Figure 15:
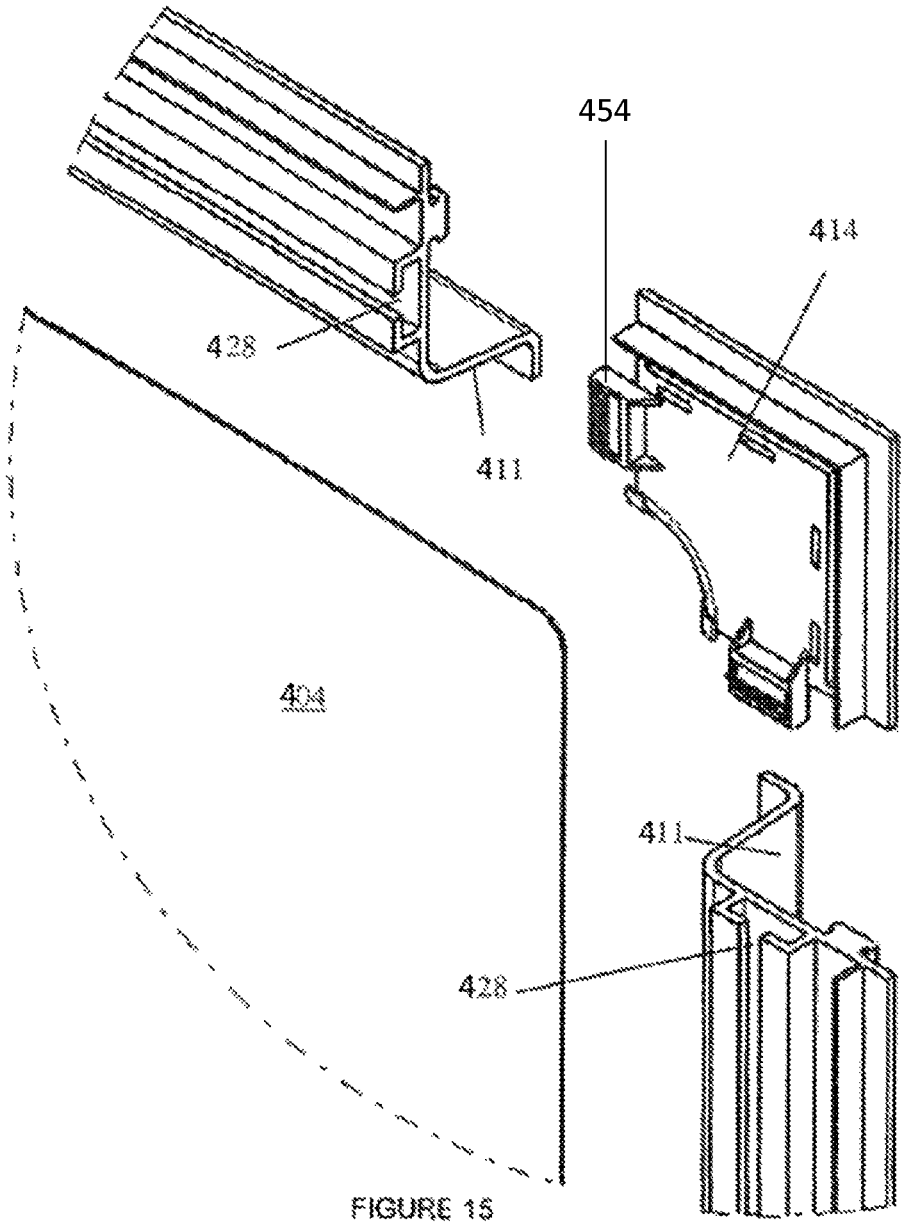
FIG. 15 illustrates the side member extrusion profile to form a corner with the corner connector of FIG. 9.

FIG. 15 illustrates a side member extrusion adapted for use with the corner connector of FIG. 9. Because the corner connector 414 of FIG. 9 has only one pair of lugs, only one connector slot 428 is provided on the extrusion. The absence of the second slot enables the flange 454 to cooperate with the wall of edge 411.

Figure 16:
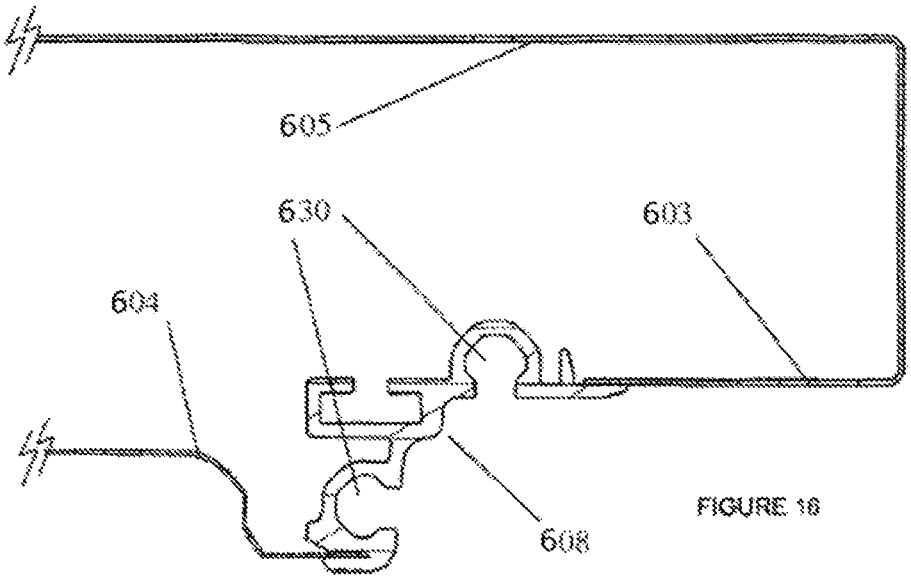
FIG. 16 illustrates a cross sectional view similar to that of FIG. 6, with an improved frame edge member and inner and outer door panel, with the inner lining having a dyke form.

Illustrated in FIG. 16 is a side member extrusion 608 which is shown joined to a door inner lining 604 which has a pressed cavity or shape to give a traditional dyke formation, thereby giving the cabinet with which it is used a greater volume than the door panel of FIG. 15 of 6, where the door panels 104 and 404 are generally planar in shape.

Figure 17:
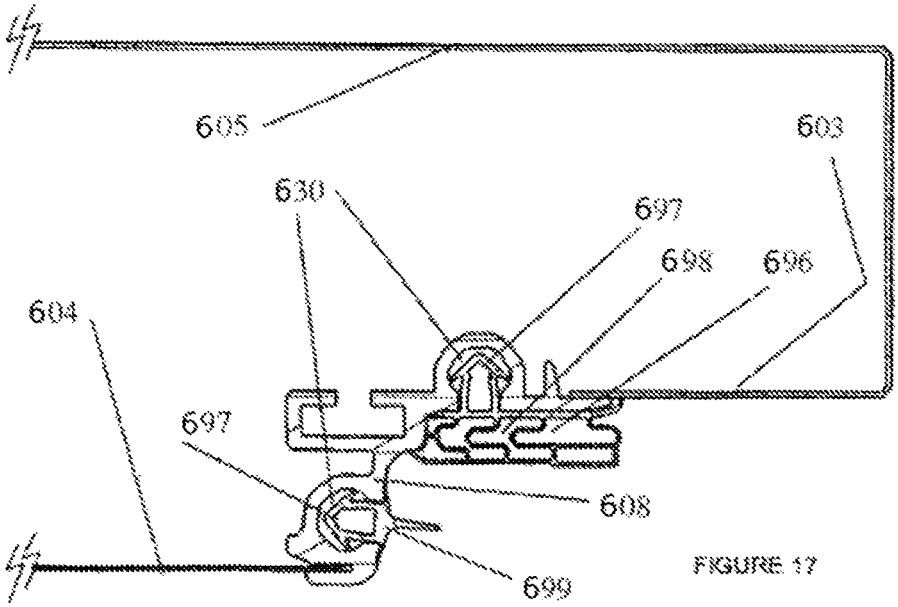
FIG. 17 illustrates a cross sectional view similar to FIG. 6, with the inner lining having a generally flat structure, and showing the placement of gaskets.

The extrusion 608 has a generally L-shaped configuration with two gasket receiving channels 630, which as is seen in FIG. 17, receives gaskets 698 and 699. The gasket 698 is of the compression type and has an elongated barb 697 to be received and held by the channel 630 and an elongated encapsulated magnetic portion 696 to seal this portion of the door panel to an outward rim of a cabinet. The gasket 699 is a wiper or cantilever type seal or gasket, which will allow this portion of the door to make wiping contact with an inner surface of a cabinet, to provide an additional sealing contact. The seal 699 also has an elongated barb 697 to mount it into a respective channel 630.

In both the FIGS. 16 and 17 assemblies, the components 605, 603, 608, 604 are all held together by the foaming in of the internal cavity of the assembly. The extrusions 608 provide, greater opportunity for the foam, once it sets, to lock into or onto the inboard surfaces of the extrusions 608.

Figure 18:
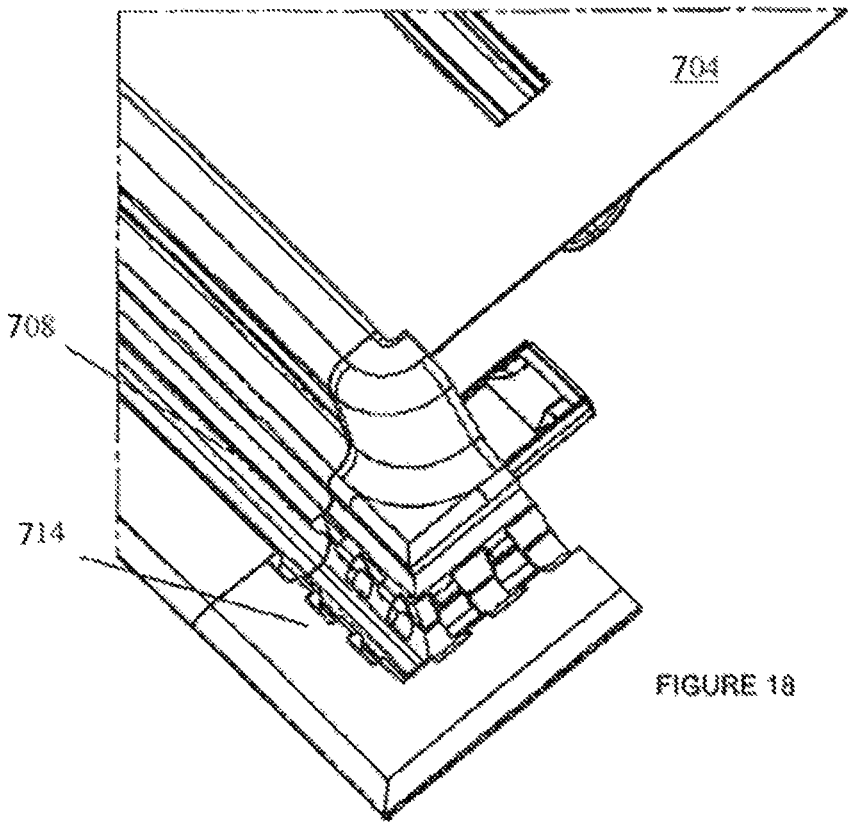
FIG. 18 illustrates a perspective view of a frame member, inner panel and corner member part way through assembly.

FIG. 18 illustrates the assembly of panel 704, extrusion 708 and a corner 714, such as in FIG. 15, but showing a reverse side view, and with the extrusion 608 of FIG. 16 or 17. This sub-assembly is prior to the insertion of the gaskets into the respective gasket channels. As is seen in FIG. 18, the corner 714 includes grooves to match the grooves on the extrusion 708, so as to receive a gasket or seal.

Figure 19:
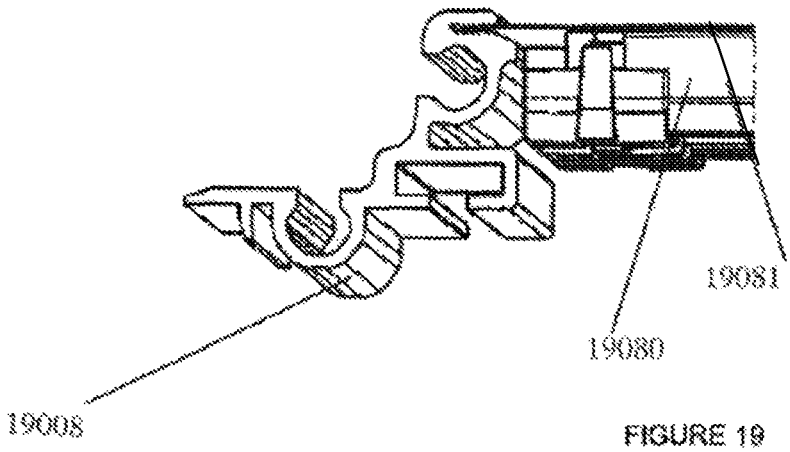
FIG. 19 illustrates a perspective view partial cross section through a frame member and inner lining having a bin slot assembly.
Figure 20:
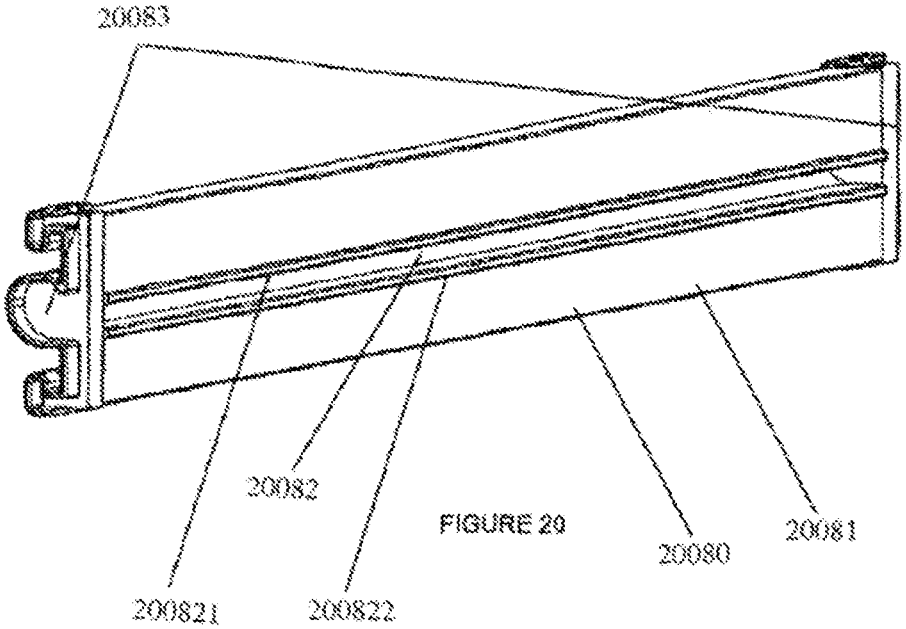
FIG. 20 illustrates a perspective view of a bin slot sub-assembly.

FIG. 19 illustrates the assembly of an extrusion 19008, panel 19081 and a bin slot sub-assembly or member 19080, which is illustrated in more detail in FIGS. 20 to 23. As illustrated in FIG. 20 the bin slot sub-assembly 20080 has an extruded aluminum or polymeric central body 20081, which has a central horizontal groove or channel 20082, which on its upper and lower outer edges protruding lips 200821 and 200822. At each end of the central body 20081 are like shaped end caps 20083, which seals the ends of the central body. The groove 20082 is shaped to receive an end of a bin or shelf or hook, the end having a mating shape to the shape of the groove 20082. Once in the groove, the shape of the end requires the bin shelf or hook to be rotated upwards to remove it from the groove 20082. However, once in the groove 20082, the bin shelf or hook can be moved relatively freely to any location therealong. The bin slot sub-assembly 20080 will be foamed into place with all the other door components for forming an assembled door.

The central body 20081 is preferably manufactured as an extrusion of a suitable polymeric material or of a metal such as aluminum, depending upon the design life or the quality level to be produced. An advantage of extruding the central body is that better dimensional tolerances are produced for the groove by comparison with the vacuum forming of the bin slots directly into the door lining.

Figure 21:
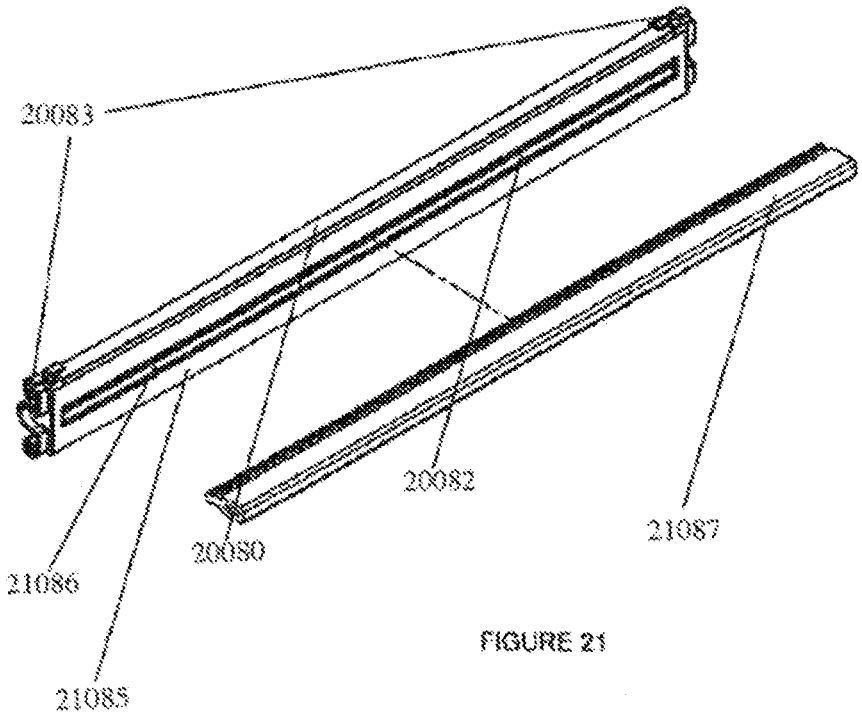
FIG. 21 illustrates a perspective view of two steps in a bin slot sub assembly procedure.
Figure 22:
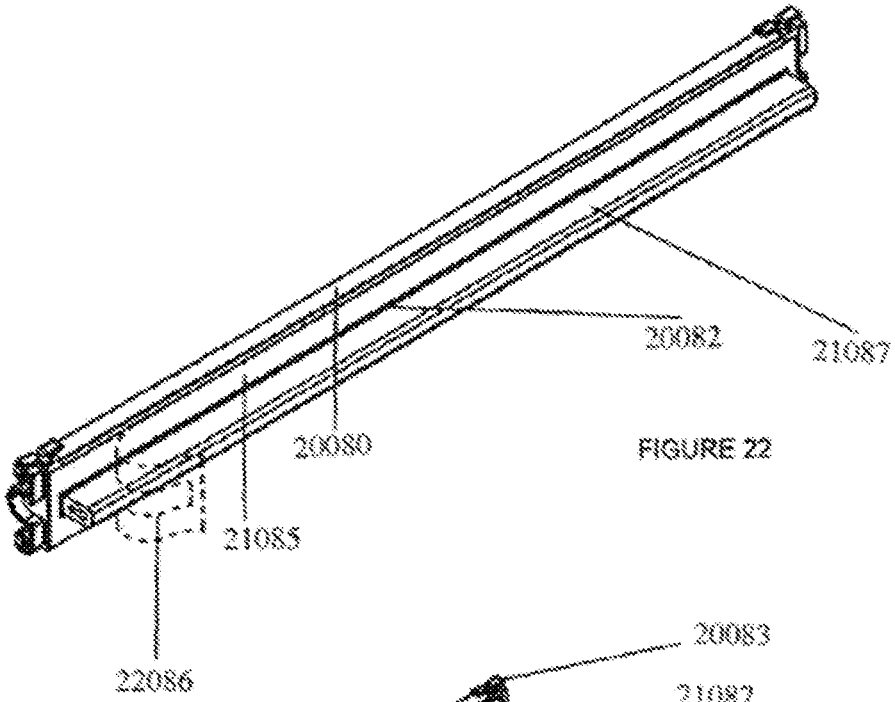
FIG. 22 illustrates a perspective view of a further step in a bin slot sub assembly procedure.
Figure 23:
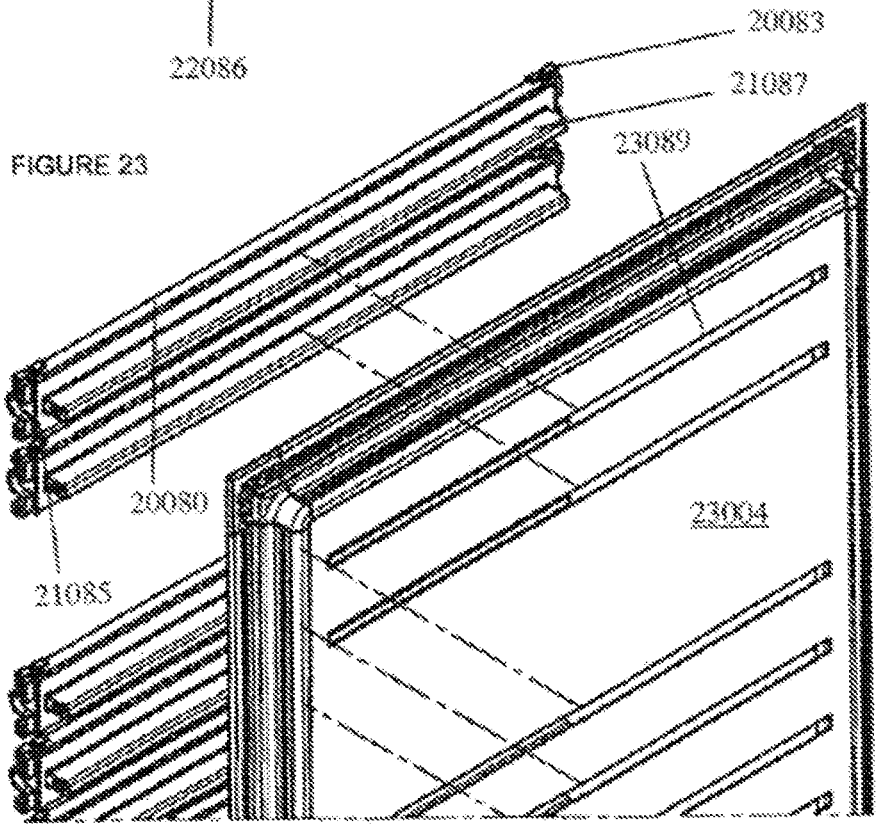
FIG. 23 illustrates a perspective view of a final steps in a bin slot sub assembly procedure with respect to the door lining.

FIGS. 21 to 23 illustrate steps in a sub-assembly procedure for assembling the bin slots to a door lining.

As illustrated in FIGS. 20 to 23, first the ends 20083 are assembled to the central body 20081. Once this has been done, as illustrated in FIG. 21, a rectangular piece of double sided tape 21085, which has a rectangular aperture 21086, overlays the ends 20083 and the central body 20081. At this time the external cover or backing (see 22086) over the double sided tape 21085 has not been removed.

Once the double sided tape 21085 has been positioned, a locating jig 21087 is positioned inside the groove 20082. The locating jig 21087 assists in aligning the groove 20082, and thus the bin slot 20080, in the door lining as will be explained below.

As illustrated in FIGS. 22 and 23, after the locating jig 21087 inside the groove 20082, the backing 22086 is peeled off so as to expose the adhesive on the outer surface of the double sided tape 21085. Then as shown in FIG. 23, the sub-assembly, with exposed outer surface adhesive on the double sided tape 21085 is brought into contact with the rear surface of door lining 23004 having elongated slots 23089, so that the locating jig 21087 passes through the slots 23089. By then applying hand pressure the bin slot will be adhered to the lining 23004, and the end caps 20083 are all adhered together to await the foaming in step, which will bind all the components together. At this point the jig can be removed.

As is illustrated in FIG. 24, the upper lip 200821 and lower lip 200822 of the bin slot sub assembly 20080 protrude past the outboard surface of the inner door panel 23004, so as to finish proud thereof in the assembled door panel. The distance it protrudes or finished proud of the outboard surface of the panel 23004 is of the order of 1 to 2 millimeters. The function of this arrangement is to ensure that when a door bin 2532 is mounted thereto it will not result in the door bin 2534 marking the panel 23004 when the door bin 2534 is slid in sideways directions along the bin slot sub assemblies. To assemble the door bin 2534 to the bin slot member 20080, the rear end of the door bin (illustrated in the partial side view of a door bin in FIG. 25) is mounted so that its upper and lower mounting rails 2533 and 2534 are located in an pair of vertically spaced grooves 20082 in parallel mounted bin slot sub assemblies 20080, in the finished appliance. This arrangement helps to maintain the condition of the door panel during use by an end user.

If desired the length of protrusion of the upper lip 200821 and lower lip 200822 can be increased, wherein the lips can act as a locating jig to guide the bin slot onto the inboard side of the door panel during sub assembly, thereby removing the need for a locating jig such as jig 21087. In such an embodiment the bin slot member will have its own permanently attached locating jig.

The standardized extrusion and corner connectors facilitate the ready adaptation of the dimensions of a door, as the only changes are to the length of the side members and the corresponding change to the dimensions of the inner and outer panels. The corner pieces also obviate the need to mitre the corners of the side members.

The components of the insulated door according to an embodiment of the invention are suitable for transport as a flat pack. The door can be assembled at a suitable location and foam insulation can be injected.

In this specification, reference to a document, disclosure, or other publication or use is not an admission that the document, disclosure, publication or use forms part of the common general knowledge of the skilled worker in the field of this invention at the priority date of this specification, unless otherwise stated.

In this specification, terms indicating orientation or direction, such as "up", "down", "vertical", "horizontal", "left", "right" "upright", "transverse" etc. are not intended to be absolute terms unless the context requires or indicates otherwise. These terms will normally refer to orientations shown in the drawings.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. An insulated assembly including a frame, a first panel attached to the frame, and a second panel attached to the frame, the second panel comprising a bin slot member comprising a central body portion having a groove that is shaped to receive a mating protrusion on a storage bin and a contact surface adjacent the groove, wherein the at least one bin slot member is aligned to the second panel by:

positioning a jig inside the groove of the bin slot member;

moving the bin slot member toward the second panel such that the jig passes through a corresponding slot on the second panel; and bringing the contact surface into contact with the second panel; and wherein the jig is shaped such that the jig must be removed from the groove to allow the mating protrusion of the storage bin to fit into the groove.

2. The insulated assembly of claim 1, wherein the first panel is an external panel, and is made of a material selected from the group consisting of stainless steel, polymer coated sheet metal and painted sheet metal.

3. The insulated assembly of claim 1, wherein the second panel is generally planar in shape.

4. The insulated assembly of claim 1, wherein the second panel is generally non-planar in shape.

5. The insulated assembly of claim 1, wherein the central body is extruded from one of a polymeric material, or a metal.

6. The insulated assembly of claim 1, wherein the groove has two ends, wherein end caps are provided to close off each of the two ends of the groove.

7. The insulated assembly of claim 6, wherein the end caps comprise respective attachment surfaces corresponding to shape to the contact surface of the bin slot member.

8. The insulated assembly of claim 1, wherein along an upper and lower edge of the groove is located a protruding lip, which is adapted to protrude through and finish proud of the corresponding slot on the second panel.

9. The insulated assembly of claim 1, wherein the assembly is adapted for use in a cold appliance.

10. The insulated assembly of claim 5, wherein said metal is aluminum.

11. The insulated assembly of claim 1, wherein the contact surface comprises at least one adhesive element and wherein bringing the contact surface into contact with the second panel attaches the bin slot member to the second panel.

12. The insulated assembly of claim 11, wherein the at least one adhesive element comprises double sided tape.

13. An insulated assembly system, comprising:

a first panel;

a second panel including a corresponding slot;

a bin slot member configured to be positioned between the first panel and the second panel, the bin slot member comprising:

a central body portion having a groove that is shaped to receive a mating protrusion on a storage bin; and a contact surface adjacent the groove; and a jig adapted for insertion into the shaped groove and configured to pass through the corresponding slot of the second panel, such that the jig aligns the groove with the corresponding slot when the jig is inserted into the groove and passes through the corresponding slot, thereby bringing the contact surface of the bin slot member into contact with the second panel, wherein the jig is shaped such that the jig must be removed from the groove to allow the mating protrusion of the storage bin to fit into the groove.

14. The system of claim 13, wherein the contact surface comprises an adhesive that attaches the bin slot member to the second panel when the contact surface is brought into contact with the second panel.

15. The system of claim 14, wherein the adhesive comprises double sided tape.

16. The system of claim 13, wherein the jig is sized to pass entirely through the corresponding slot of the second panel.

17. The system of claim 1, wherein the jig is sized to pass entirely through the corresponding slot of the second panel.

* * * * *